US006354937B1

(12) United States Patent
Crook

(10) Patent No.: US 6,354,937 B1
(45) Date of Patent: Mar. 12, 2002

(54) FLEXIBLE DUCT SLEEVE

(76) Inventor: Dale J. Crook, 13745 W. 121st Ter., Olathe, KS (US) 66062-6093

( * ) Notice: Subject to any disclaimer, the term of this patent is extended or adjusted under 35 U.S.C. 154(b) by 0 days.

(21) Appl. No.: 09/498,783

(22) Filed: Feb. 5, 2000

(51) Int. Cl.[7] ..... F24F 13/06

(52) U.S. Cl. ..... 454/292; 138/106; 138/172; 138/DIG. 8; 248/74.4; 285/114

(58) Field of Search ..... 285/114, 115, 285/116; 138/110, 172, DIG. 8, 106; 248/74.4; 454/292

(56) References Cited

U.S. PATENT DOCUMENTS 1,891,874 A * 12/1932 Elkins
2,172,130 A * 9/1939 Powell
4,795,197 A * 1/1989 Kaminski et al.
5,989,006 A * 11/1999 Godeau et al. ..... 138/106 X

* cited by examiner

*Primary Examiner*—Harold Joyce
(74) *Attorney, Agent, or Firm*—Mark E. Brown

(57) ABSTRACT

A sleeve assembly for supporting flexible duct includes a frame with first and second frame sections. The frame sections are secured together by fastener subassemblies. The sleeve assembly accommodates flexible duct in various angular and straight configurations. The frame can comprise various suitable materials and skeletal or solid-exterior construction. The sleeve assembly is adapted for various installations in air distribution systems of heating, ventilating and air conditioning systems.

20 Claims, 7 Drawing Sheets

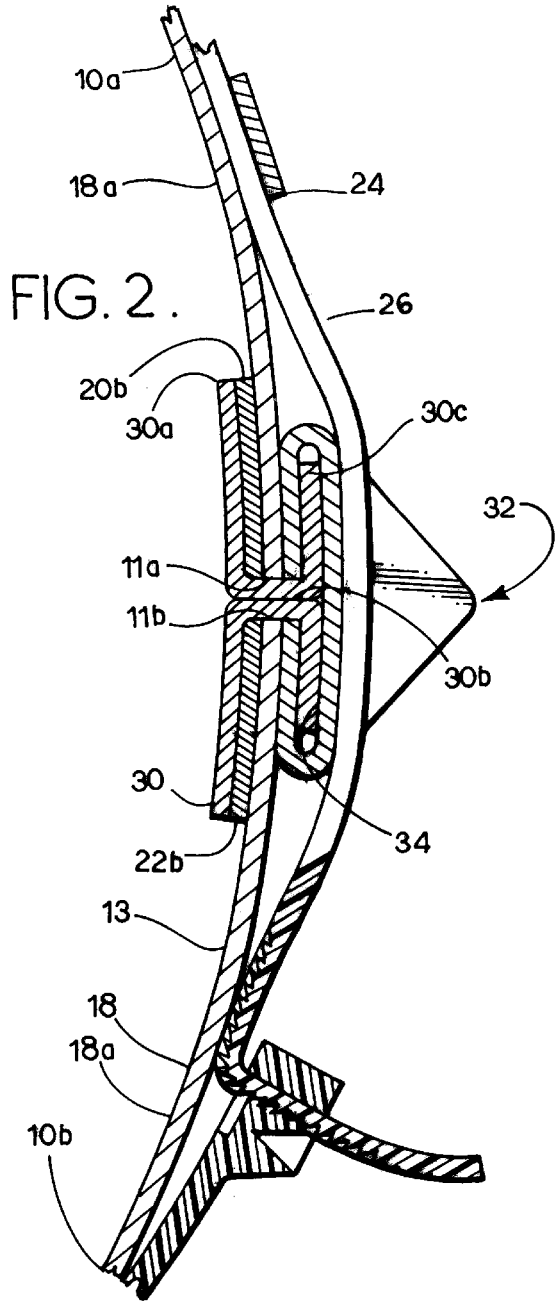
FIG. 2.
FIG. 3.
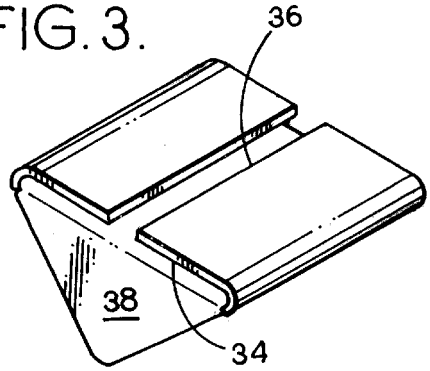
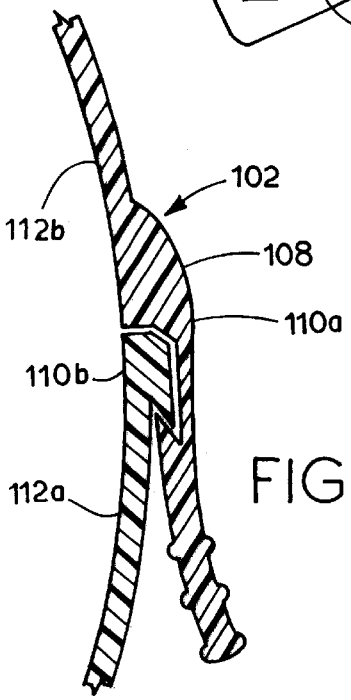
FIG. 4.

FLEXIBLE DUCT SLEEVE

BACKGROUND OF THE INVENTION

1. Field of the Invention

The present invention relates generally to ductwork for heating, ventilating and air conditioning ("HVAC") systems, and in particular to a sleeve for protecting a length of flexible hose from crimping.

2. Description of the Prior Art

Hoses, ducts and conduits in various sizes and configurations are commonly utilized for conveying, routing and directing various substances and objects. In dynamic systems, examples of such substances include air which has been heated or cooled by heating and air conditioning equipment. In the construction industry such systems are commonly referred to as heating, ventilating and air conditioning (HVAC) systems.

Typical HVAC systems include runs of ductwork extending from the heating and air conditioning equipment to additional air handling equipment, or to distribution devices. Additional air handling equipment examples include variable air volume ("VAV") boxes which are located in plenum spaces in many commercial structures. Heated and cooled air is typically introduced into the occupied spaces of buildings by diffusers which direct the airflow in predetermined distribution patterns for maximizing the comfort of the occupants.

Routing ductwork from the air conditioning and heating equipment to the supply diffusers often involves ducting routes which turn, bend and intersect with various components and with other runs of ductwork. To accommodate such curved, angled, and bent routing, flexible duct is commonly used for the final portions of the duct runs, which terminate at diffusers or other components. Flexible duct also has the advantage of being easily reconfigurable to accommodate changed space configurations and the like. Another advantage of flexible duct is that it is available with insulation to avoid condensation during cooling operation.

However, a disadvantage of flexible duct is that it tends to crimp when bent (FIGS. 5*a*, 6*a* and 7*a*). For example, 90° turns into diffusers can crimp unprotected flexible ducts. Crimping tends to restrict air flow and lower overall system efficiency. HVAC equipment thus works harder and consumes more power to overcome flow resistance associated with crimped flexible ducts.

A prior art solution to the problem of flexible duct crimping at diffusers and other bending locations is to install metal elbows, as shown in FIG. 7*b*. However, such additional components involve additional labor and material costs. Also, insulation may be required and further increase the installation costs.

The present invention addresses these disadvantages of prior art flexible duct installations. Heretofore there has not been available a sleeve for flexible duct with the advantages and features of the present invention.

SUMMARY OF THE INVENTION

In the practice of the present invention, a sleeve assembly is provided for flexible ducts. The sleeve assembly includes a frame comprising first and second frame sections selectively secured together by fastener subassemblies. The frame includes first and second ends and a longitudinal axis extending therebetween. The sleeve assembly can subtend an appropriate angle for supporting a length of flexible duct through a corresponding bend. The frame includes multiple rings formed by ring halves each located in a respective frame section. Each frame section also includes multiple longitudinal members interconnecting respective ribs. The sleeve assembly is adapted for accommodating various applications and installations involving flexible duct, either straight or bent.

OBJECTS AND ADVANTAGES OF THE INVENTION

The principal objects and advantages of the invention include:

- providing a sleeve assembly for flexible duct;
- providing such a sleeve assembly which reduces crimping in flexible ducts;
- providing such a sleeve assembly which enhances air distribution system efficiency;
- providing such a sleeve assembly which can accommodate various flexible duct bend configurations;
- providing such a sleeve assembly which can be fabricated from various materials;
- providing such a sleeve assembly which can eliminate the need for metal elbows in air distribution systems;
- providing such a sleeve assembly which can be manufactured from various components; and
- providing such a sleeve assembly which is economical to manufacture, efficient in operation, capable of a long operating life and particularly well adapted for the proposed uses thereof.

BRIEF DESCRIPTION OF THE DRAWINGS

FIG. 2 is an enlarged cross-sectional view thereof taken generally along line 2—2 in FIG. 1.

FIG. 3 is a perspective view of a coupling thereof.

FIG. 4 is an enlarged, cross-sectional view of an alternative construction thereof.

DETAILED DESCRIPTION OF THE PREFERRED EMBODIMENTS

I. Introduction and Environment

Figure 1:
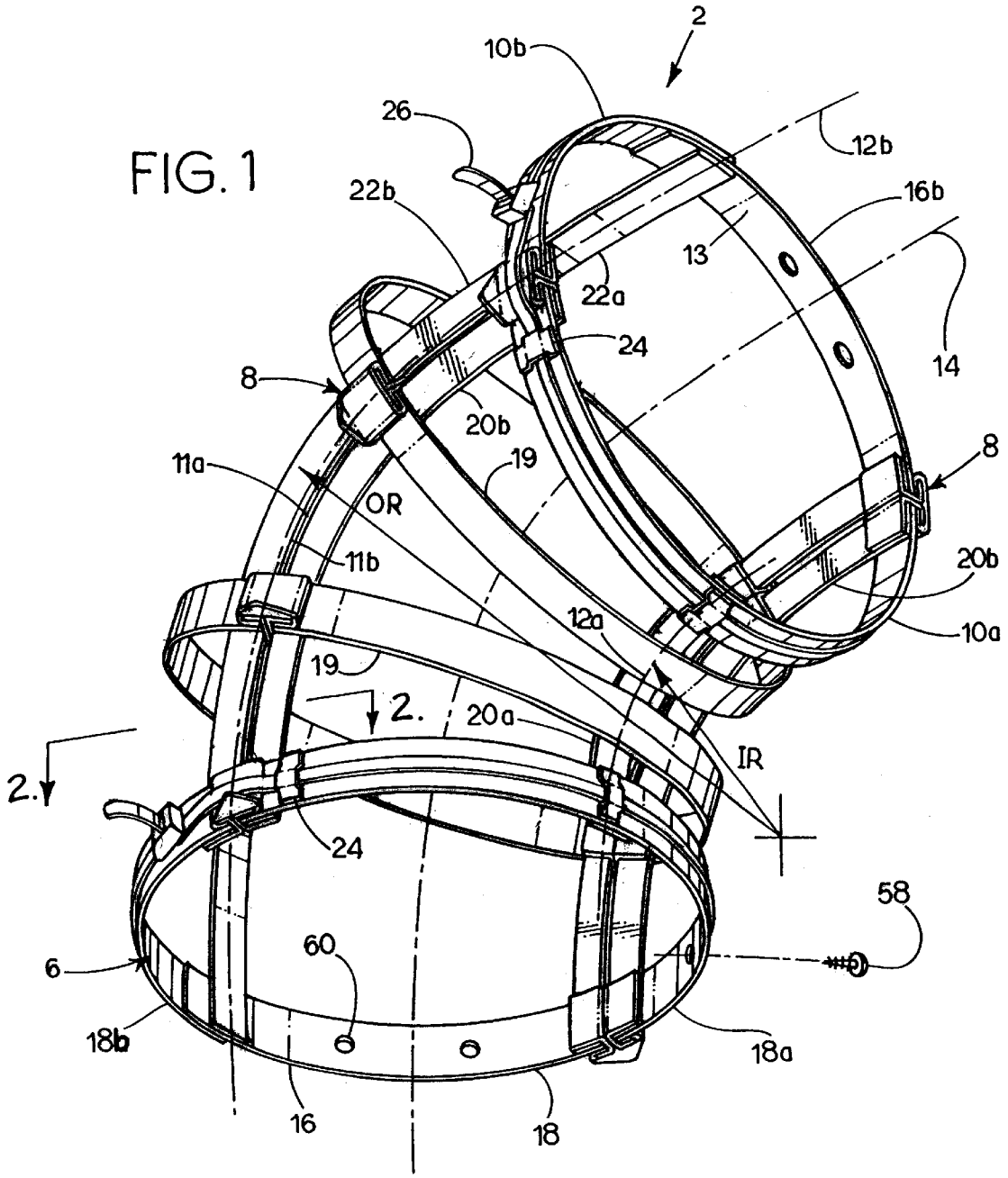
FIG. 1 is a perspective view of a sleeve assembly for a flexible duct embodying the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 2 generally designates a sleeve assembly for a flexible member, such as a length of flexible duct 4. Without limitation on the generality of useful applications of the sleeve assembly 2, the flexible duct 4 received in same can comprise a portion of the ductwork in a heating, ventilation and air conditioning ("HVAC") system in a building.

The sleeve assembly 2 generally comprises a skeletal frame 6 secured together by multiple fastener subassemblies 8.

II. Frame 6

The frame 6 comprises first (inner) and second (outer) frame sections 10*a,b* with an inner radius ("IR") arc 12*a* and an outer radius ("OR") arc 12*b* respectively. A longitudinal axis 14 extends between opposite ends 16 of the frame 6 in generally parallel relation to the radius arcs 12*a,b*. A passage 13 follows the longitudinal axis 14 and receives the flexible duct 4. The frame 6 includes a plurality of annular rings 18 each comprising a pair of ring halves or ribs 18*a,b* associated with a respective frame section 10*a,b*. As shown, the frame 6 extends through an arc of approximately 90° and includes four rings 18, two of which are located adjacent to the frame ends 16 and the remaining two of which are located intermediate same whereby the rings 18 are spaced at approximately 30° radial intervals forming gores 19 separated by respective adjacent rings 18.

The inner frame section 10*a* includes an inside radius longitudinal member 20*a* and a pair of side longitudinal members 20*b* which extend in generally parallel relation with respect to the longitudinal axis 14 and interconnect respective ribs 18*a*. The outer radius frame section 10*b* includes an outer radius longitudinal member 22*a* and a pair of side longitudinal members 22*b*. The rings 18 adjacent to the frame ends 16 include loops 24 mounted thereon in radially-spaced relation for receiving ties 26 which are adapted for securing the frame sections 10*a,b* together.

III. Fastener Subassembly 8

The frame sections 10*a,b* are secured together by the fastener subassemblies 8, each of which includes a pair of tabs 30 mounted on respective side edges 11*a,b* of the frame sections 10*a,b*. Each tab includes an inner leg 30*a*, a connector 30*b* and an outer leg 30*c* (FIG. 2). As shown in FIG. 2, the tabs 30 can be located at the connections between the ribs 18*a* and respective longitudinal members 20*a,b* and 22*a,b*. With the frame sections 10*a,b* placed together with their respective side edges 11*a,b* adjacent to each other, the tab connectors 30*b* are located adjacent to each other with the tab outer legs 30*c* projecting outwardly.

Each fastener subassembly 8 further includes a respective coupling 32 with a channel 34 receiving the tab outer legs 30*c* and a slot 36 receiving the tab connectors 30*b*. Each coupling 32 includes an extension 38 adapted to be grasped by an installer to facilitate mounting same. The sleeve assembly 2 described thus far can be fabricated of sheet metal stamped and folded into the desired configuration.

IV. Modified Embodiment Sleeve Assemblies

A sleeve assembly 102 comprising a first modified embodiment of the present invention is shown in FIG. 4 and can be molded from plastic or some other suitable material. The sleeve assembly 102 includes a modified fastener subassembly 108 with a first notched latch member 110*a* integrally formed with a respective first frame section 112*b* and a second notched latch member 110*b* integrally formed with a second frame section 112*a*.

Still further, the sleeve assembly can have a generally tubular configuration which is fully enclosed throughout its entire length with a solid exterior open only at its ends. Such an enclosed or solid exterior configuration could be formed from molded plastic, stamped sheet metal, etc. Sleeve assemblies can be fabricated with various numbers of "gores" 19, which comprise the sections between respective rings. Thus, the frame 6 disclosed has three gores of approximately 30° each whereby the frame 6 subtends an angle of approximately 90° (30°×3=90°). However, other angular configurations and other numbers of gores could be employed to meet the requirements of particular installations.

Moreover, various angles, radii and diameters can be utilized. The material comprising the frame can comprise, for example, plastic, fiber glass, sheet metal, wire, carbon fiber, etc.

Still further, sleeve assemblies can be constructed of multiple chains thereof secured together. Thus, straight pieces could be combined with elbows, and various angular configurations could be assembled from smaller, angle components or elbows.

V. Installations

Figure 5:
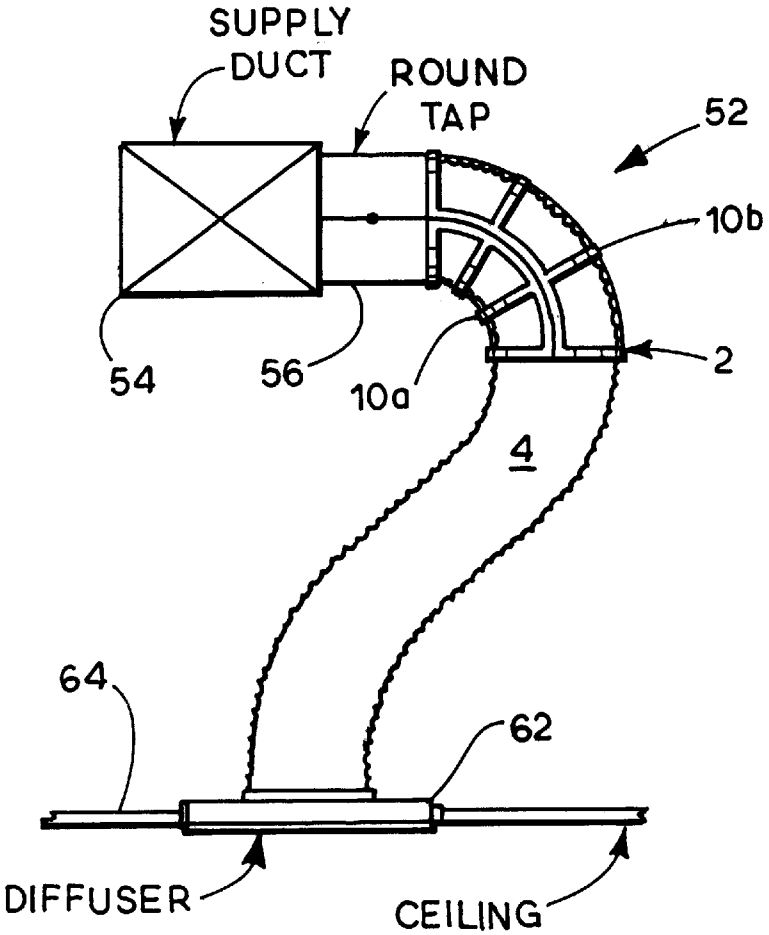
FIG. 5 is a side elevational view of a first installation of the sleeve assembly.

FIG. 5 shows a first installation or application of the sleeve assembly 2 in an HVAC system 52 including a supply duct 54 and a round tap 56 connected to same. The sleeve assembly 2 secures the end of a length of flexible duct 4 to the round tap 56 and supports same through a flexible duct bend 5*a*. The sleeve assembly 2 can be secured to the flexible duct 4 and the round tap 56 by any suitable means, including mounting screws 58 extending through receivers 60 formed in the rings 18 adjacent to the frame section ends 16. Ties 26 can also be utilized for providing annular constriction of the sleeve assembly 2 on the flexible duct 4 and the round tap 56. The flexible duct 4 extends from the sleeve assembly 2 to a diffuser 62 mounted in a ceiling 64.

Figure 5A:
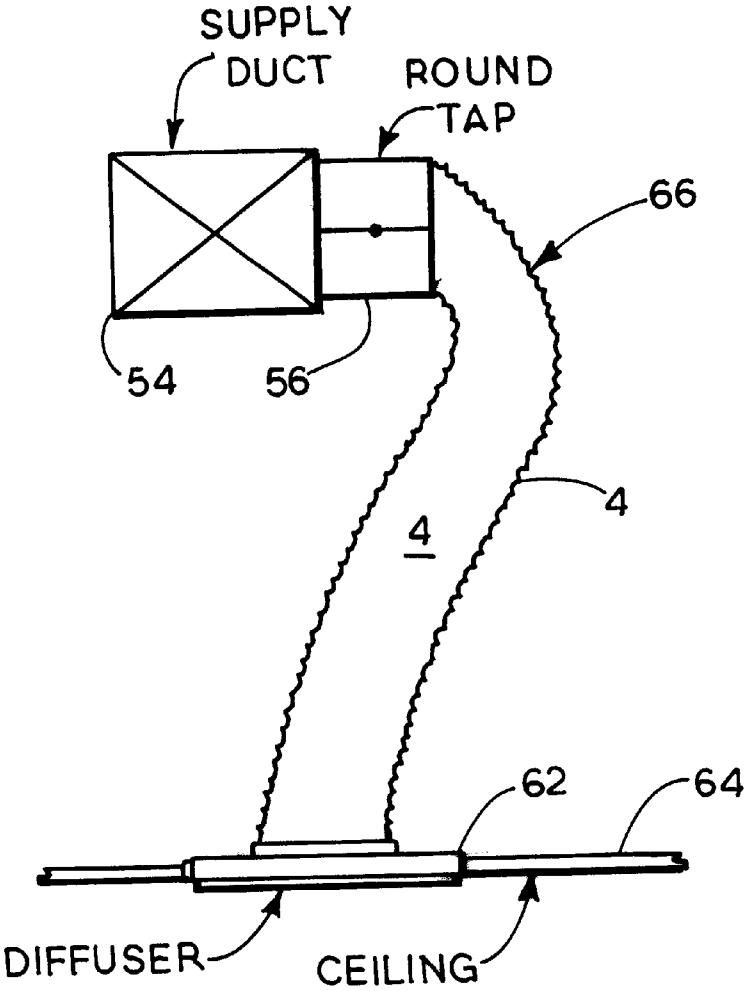
FIG. 5*a* is a side elevational view of a prior art configuration of the installation shown in FIG. 5.

A prior art configuration is shown in FIG. 5*a* and illustrates a potential restricted flow choke point 66, which is avoided by the use of a sleeve assembly 2.

Figure 6:
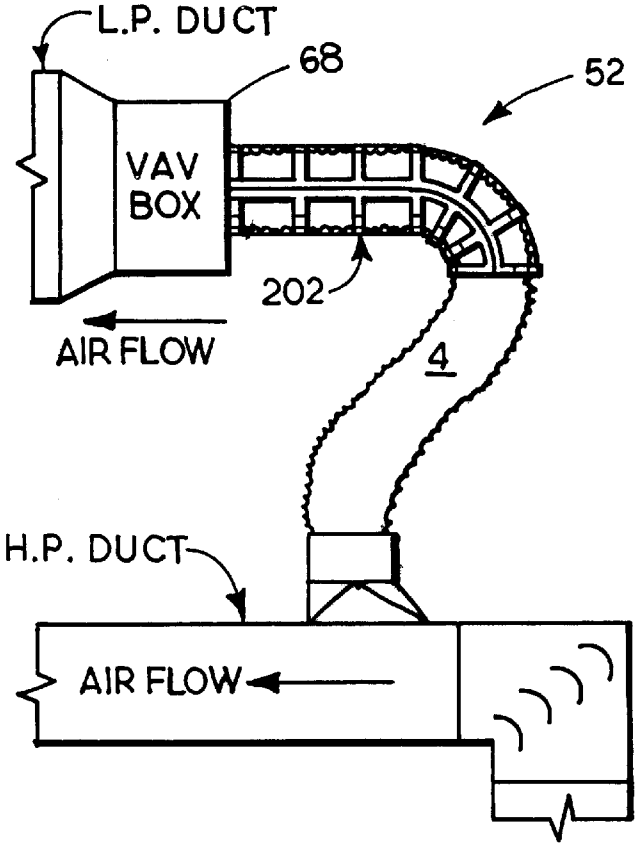
FIG. 6 is a plan view of a second installation of the sleeve assembly.

FIG. 6 shows an installation of a modified, extended length sleeve assembly 202 connecting a length of flexible duct 4 to a variable air volume ("VAV") box 68. The extended length of the sleeve assembly 202 accommodates the operation of the VAV box 68 by providing a relatively straight length adjacent to the VAV box 68 inlet to enable its sensors to perform effectively pursuant to manufacturers' recommendations.

Figure 6A:
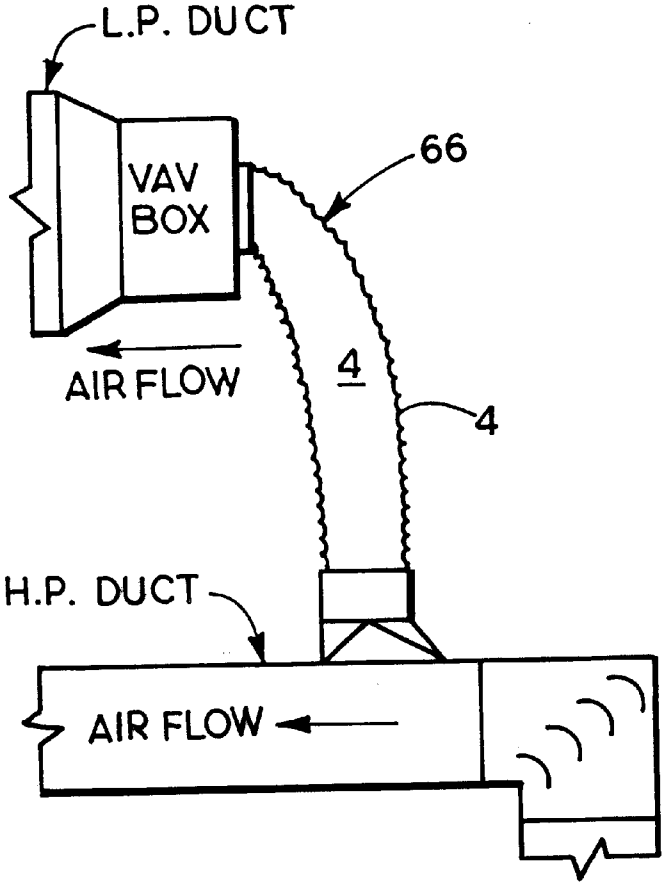
FIG. 6*a* is a plan view of a prior art configuration of the installation shown in FIG. 6.

FIG. 6*a* shows a prior art configuration for connecting a length of flexible duct 4 to a VAV box 68 whereby a choke point 66 can occur. Moreover, with the prior art configuration shown in 6*a*, the necessary uninterrupted straight run from the flexible duct 4 into the VAV box 68 is not accommodated.

Figure 7:
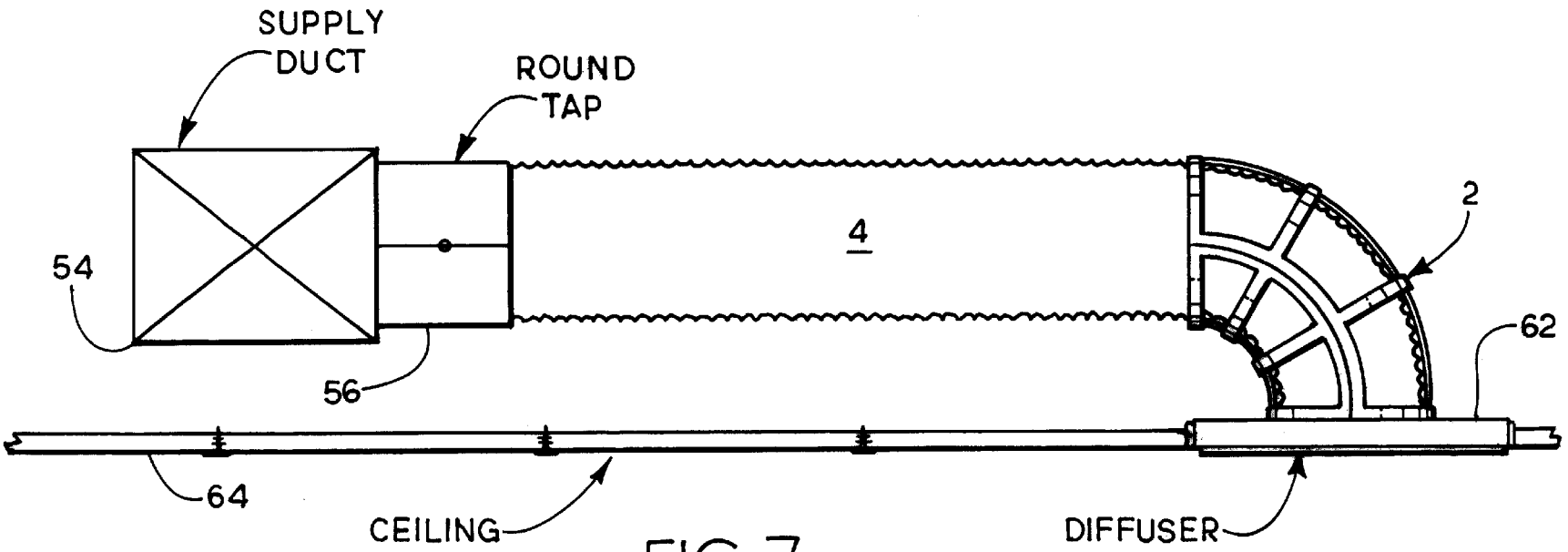
FIG. 7 is a side elevational view of a third installation of the sleeve assembly.
Figure 7A:
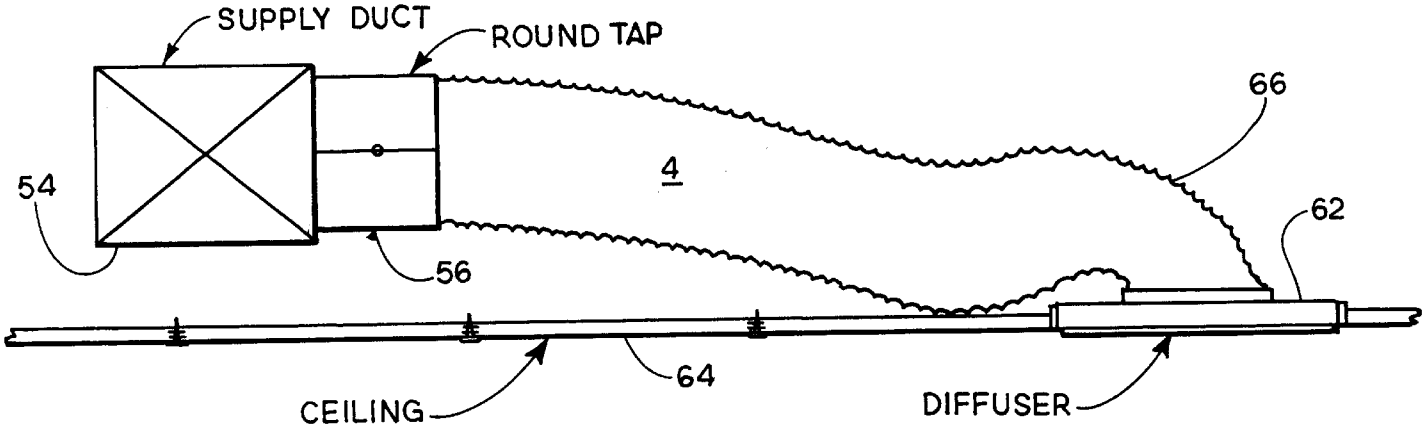
FIG. 7*a* is a side elevational view of a prior art configuration of the installation shown in FIG. 7, including a crimped flexible hose.
Figure 7B:
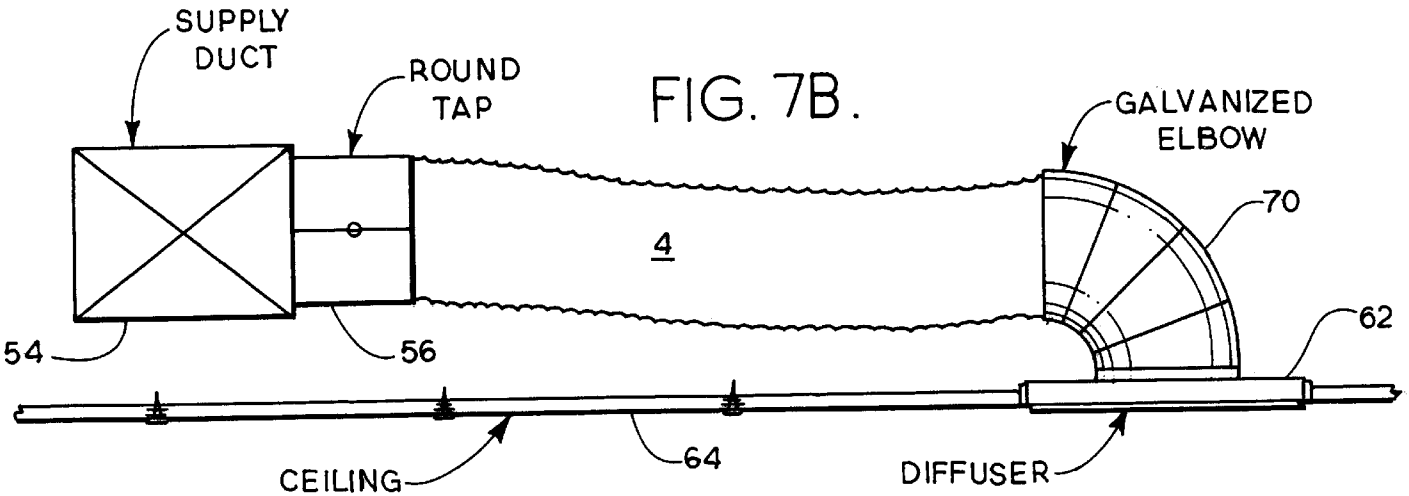
FIG. 7*b* is a side elevational view of a prior art configuration of the installation shown in FIG. 7, with a galvanized, sheet metal elbow transitioning from a length of flexible duct to a ceiling diffuser.

FIG. 7 shows a sleeve assembly 2 coupling a length of flexible duct 4 directly to a diffuser 62. Prior art construction details for this configuration are shown in FIGS. 7*a* and 7*b*. FIG. 7*a* shows the potential choke point 66 which can form if no special consideration is given to maintaining the shape of the flexible duct 4 through a 90° turn as it enters a diffuser 62. FIG. 7*b* shows a prior art solution to this problem wherein a galvanized elbow 70 is connected to the flexible duct 4 and to the diffuser 62.

Figure 8:
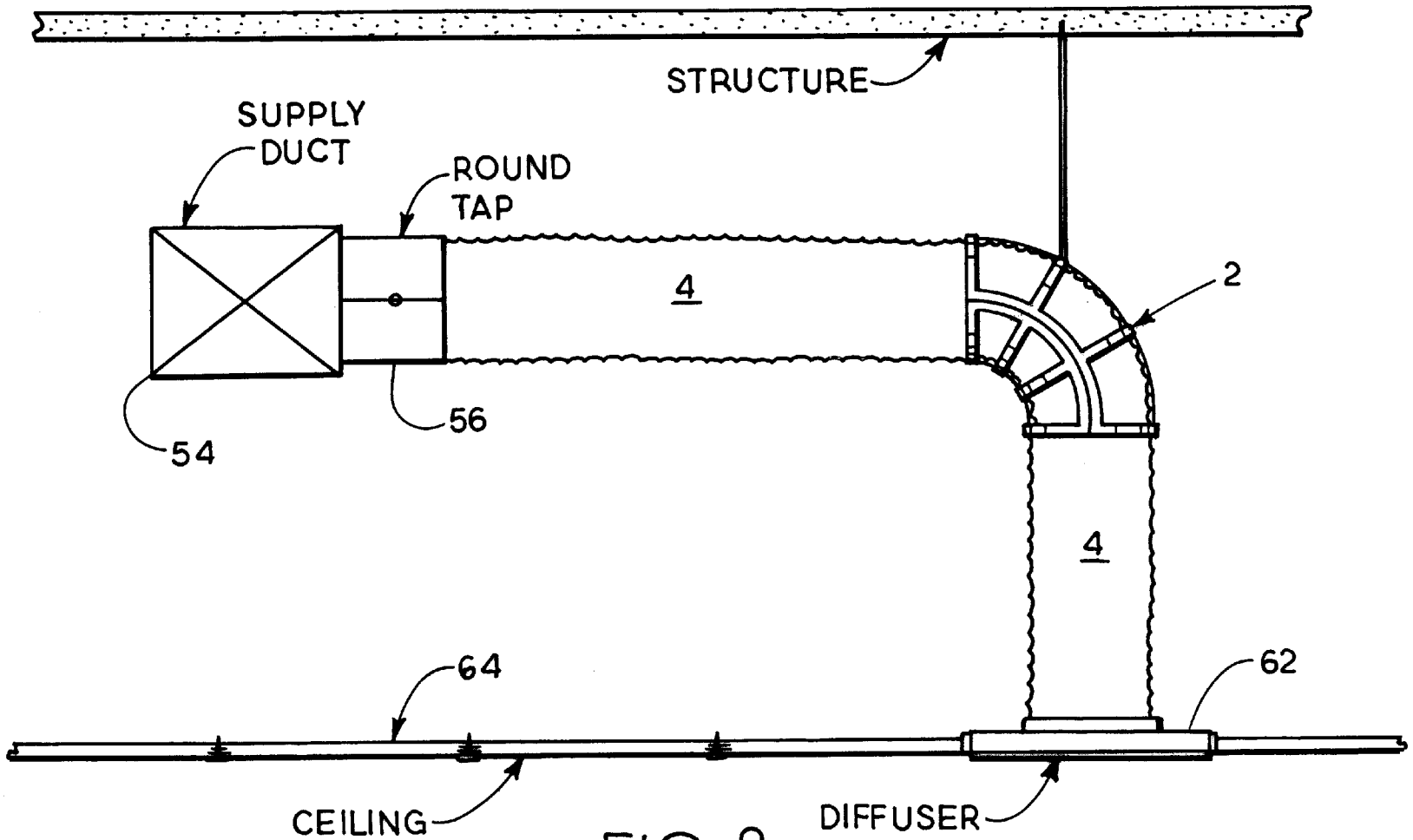
FIG. 8 is a side elevational view of an installation of the sleeve assembly at a 90° bend of a flexible duct, shown suspended from the underside of a floor slab.

FIG. 8 shows another installation of the sleeve assembly 2 for supporting a length of flexible duct 4 at a bend 4*a* thereof located intermediate a supply duct 54 and a diffuser 62.

What is claimed and desired to be secured by Letters Patent is as follows:

1. In combination with an air handling system of a heating, ventilating and air conditioning system, including a supply duct, a diffuser and a length of flexible hose interconnecting same and including an arcuate bend, the improvement of a sleeve assembly which comprises:

a) first and second ends;

b) a passage extending between and open at said ends, said passage selectively receiving the length of flexible duct;

c) a frame generally conforming to the exterior shape of the flexible duct and including first and second frame sections; and d) a frame fastener for securing said first and second frame sections together with the length of flexible duct located in said passage.

2. The invention of claim 1 wherein said frame has a longitudinal axis extending between said sleeve ends and a curved configuration curving through an angle in the range of approximately 15 degrees to 180 degrees.

3. The invention of claim 2 wherein said sleeve ends lie in respective planes generally perpendicular to said sleeve axis.

4. The invention of claim 2 wherein said frame includes inner and outer radius arcs extending between said sleeve assembly ends.

5. The invention of claim 4 wherein said frame sections are joined together along at least one of said radius arcs.

6. The invention of claim 5 wherein said sections are joined together along both of said radius arcs.

7. The invention of claim 4 wherein said radius arcs are generally parallel to said longitudinal axis.

8. The invention of claim 3 wherein:

a) said frame includes first and second end rings located at said sleeve first and second ends respectively and an intermediate ring located intermediate said first and second end rings; and b) a plurality of longitudinal members extending between and connecting said rings, said longitudinal members extending in generally parallel relation with respect to said longitudinal axis.

9. The invention of claim 8 wherein each said ring comprises a pair of ribs, each said rib being located in a respective frame section.

10. The invention of claim 8, which includes:

a) an inner radius arc longitudinal member located along said inner radius arc and an outer radius arc longitudinal member located along said outer radius arc.

11. The invention of claim 10, which includes:

a) a pair of side longitudinal members each located at a respective side of said sleeve and each being part of a respective frame section.

12. The invention of claim 1 wherein said frame fastener includes:

a) a tab with first and second tab halves each mounted on a respective frame section; and b) a coupling selectively receiving said tab halves with said fastener assembly in a closed configuration thereof.

13. The invention of claim 1 wherein each said frame section includes a solid, continuous exterior surface.

14. The invention of claim 11 wherein each said frame section includes a pair of side edges and a pair of side longitudinal members located adjacent thereto, said frame sections being fastened together along respective adjacent side edges.

15. The invention of claim 1, which includes:

a) said frame comprising plastic;

b) said frame fastener comprising first and second notched latch members each mounted on a respective frame section; and c) said frame fastener having an open configuration with said latch members disengaged and a closed configuration with said latch members engaged.

16. The invention of claim 8 wherein said rings and longitudinal members comprise sheet metal.

17. In combination with an air handling system of a heating, ventilating and air conditioning system including a supply duct, a diffuser and a length of flexible duct interconnecting same and including an arcuate bend, the improvement of a sleeve assembly which comprises:

a) a frame including:

1) opposite first and second ends;

2) an inner radius frame section including an inner radius arc extending between said ends;

3) an inner radius frame section including an outer radius arc extending between said ends;

4) an arcuate longitude axis extending between said ends in generally parallel relation with respect to said arcs;

5) a plurality of annular rings, including a first end ring located adjacent to said frame first end, a second end ring located adjacent to said frame second end and an intermediate ring located between said end rings;

6) each said ring lying generally in a plane perpendicular to said longitudinal axis;

7) each said ring comprising an inner rib of said inner radius frame section and an outer rib of said outer radius frame section;

8) each said frame section including a pair of arcuate side edges; and 9) a passage extending between and open at said ends, said passage receiving said flexible duct; and b) a plurality of fastener subassemblies each mounted on said frame adjacent to said section side edges, each said fastener subassembly having an open position with said frame sections disengaged and a closed position with said frame sections engaged.

18. The invention of claim 17, which includes:

a) at least one of said end rings including a plurality of receivers; and b) a plurality of mounting screws each located in a respective ring receiver and adapted for fastening said sleeve assembly to said flexible duct and/or said diffuser.

19. The invention of claim 18, which includes:

a) said sleeve assembly comprising an elbow-configuration sleeve assembly with the first end of the frame thereof fastened to said diffuser; and b) a straight configuration sleeve assembly with first and second frame ends, said first end being connected to said elbow-configuration sleeve assembly frame second end; and c) said sleeve assemblies receiving said flexible duct.

20. A sleeve for a length of flexible duct, which comprises:

a) first and second ends;

b) a passage extending between and open at said ends, said passage selectively receiving the length of flexible duct;

c) a frame generally conforming to the exterior shape of the flexible duct and including first and second frame sections;

d) a frame fastener for securing said first and second frame sections together with the length of flexible duct located in said passage;

e) a frame having a longitudinal axis extending between said sleeve ends and a curved configuration curving through an angle in the range of approximately 15 degrees to 180 degrees;

f) said sleeve ends lie in respective planes generally perpendicular to said sleeve axis;

g) said frame including said first and second end rings located at said sleeve first and second ends respectively and an intermediate ring located intermediate said first and second end rings;

h) a plurality of longitudinal members extending between and connecting said rings, said longitudinal members extending in generally parallel relation with respect to said longitudinal axis;

i) said ring comprises a pair of ribs, each said rib being located in a respective frame section;

j) a plurality of loops each mounted on a respective rib of a respective end ring; and k) a pair of ties each encircling a respective end ring, said ties being received in said loops.

* * * * *